United States Patent [19]

Bastenhof

[11] 4,090,819

[45] May 23, 1978

[54] FUEL INJECTION PUMP WITH CAVITATION PREVENTING STEPS ALONG THE FUEL RETURN FLOW PATH

[75] Inventor: Dirk Bastenhof, Eaubonne, France

[73] Assignee: Societe d'Etudes de Machines Thermiques, Saint-Dennis, France

[21] Appl. No.: 736,570

[22] Filed: Oct. 28, 1976

[30] Foreign Application Priority Data

| | | |
|---|---|---|
| Nov. 5, 1975 | France | 75 33802 |
| Oct. 15, 1976 | France | 76 31136 |

[51] Int. Cl.[2] ..... F04B 7/04

[52] U.S. Cl. ..... 417/499; 123/139 AA

[58] Field of Search ..... 417/494, 499; 123/139 R, 139 AA, 139 BD, 139 AD

[56] References Cited

U.S. PATENT DOCUMENTS

| | | | |
|---|---|---|---|
| 2,696,786 | 12/1954 | Fleck et al. | 417/499 |
| 3,552,889 | 1/1971 | Curran et al. | 417/494 |
| 3,609,070 | 9/1971 | Bagshaw | 417/494 |
| 3,963,384 | 6/1976 | Bastenhof | 417/499 |

FOREIGN PATENT DOCUMENTS

| | | | |
|---|---|---|---|
| 1,093,960 | 5/1955 | France | 417/500 |
| 2,220,212 | 11/1972 | Germany | 123/139 AA |
| 2,160,499 | 6/1973 | Germany | 123/139 BD |
| 659,301 | 10/1951 | United Kingdom | 417/494 |

*Primary Examiner*—Carlton R. Croyle
*Assistant Examiner*—Thomas I. Ross
*Attorney, Agent, or Firm*—Jay L. Chaskin

[57] ABSTRACT

A means of damping cyclic fuel injection pressure drop in a constant-stroke, variable delivery flow rate injection jerk-pump for an internal combustion engine, consisting in slowing down fuel pressure drop at the end of every injection cycle by increasing the added pressure head losses of fuel backflow by a reduction of the free passageway cross-sections through which the fuel flows successively on its return path from the pump working chamber to the spill port.

4 Claims, 3 Drawing Figures

Figure 1:
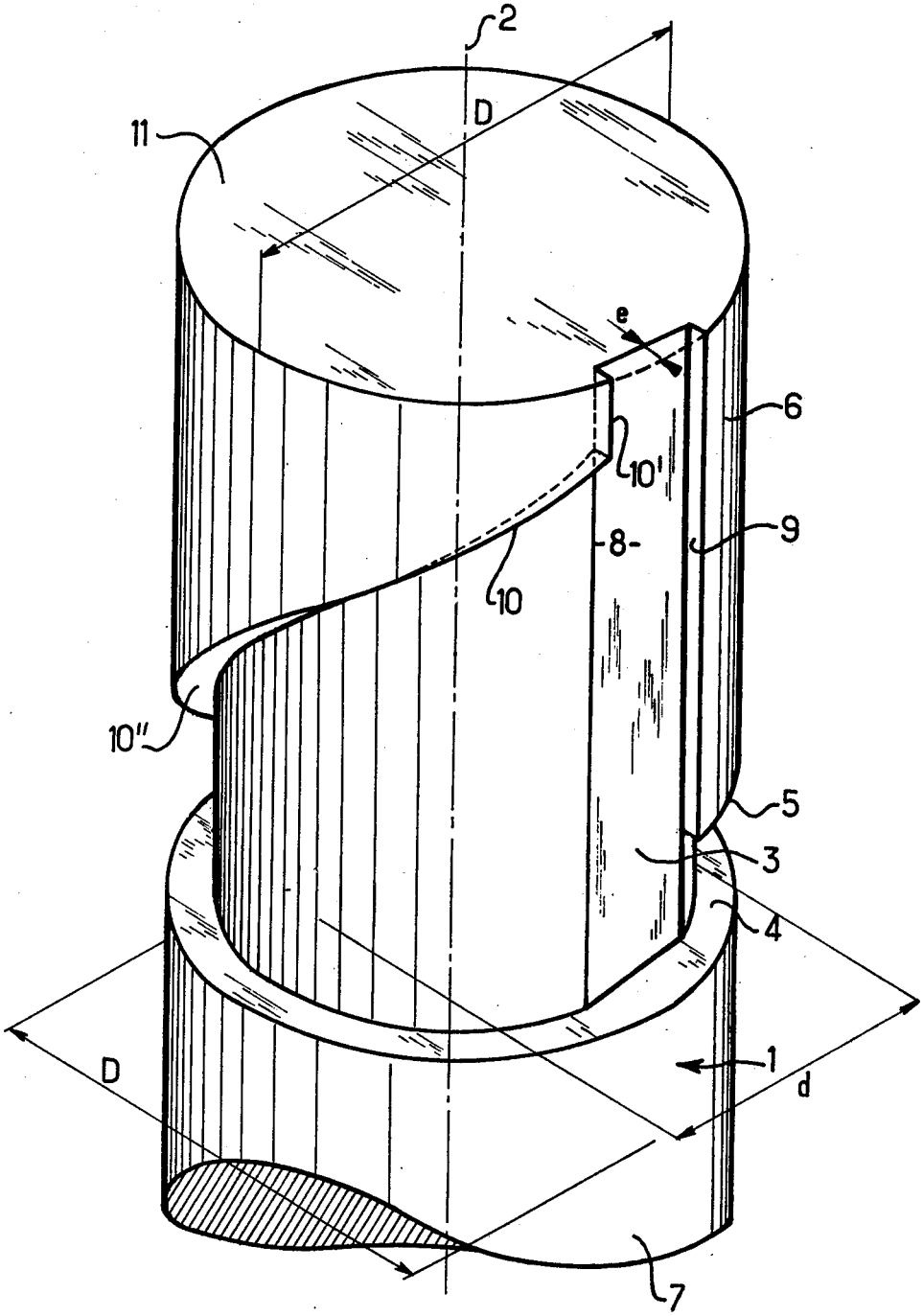

FUEL INJECTION PUMP WITH CAVITATION PREVENTING STEPS ALONG THE FUEL RETURN FLOW PATH

The present invention relates generally to and has essentially for its object a method of damping fuel injection pressure drop at the end of each injection cycle of a fuel injection jerk-pump of the constant-stroke, selectively variable delivery flow rate kind as well as a device for carrying out said method and consisting of a specially designed reciprocally movable cylindrical plunger or piston of such a positive-displacement fuel injection jerk-pump or like force-pump or ram-pump of an internal combustion engine. The invention is also directed to the various applications resulting from the use of such an improved device as well as to the systems, assemblies, apparatus, machinery, equipments and arrangements fitted with such devices.

In the prior state of the art it is known that in an internal combustion engine with fuel injection and for instance self-ignition due to compression such as in particular but not exclusively a Diesel engine, each fuel-injection jerk-pump is for instance of the single-cylinder constant linear stroke, variable by-pass type in which the working plunger or piston with its follower and return spring is actuated by an engine cam for reciprocating motion in its barrel. The pump plunger and barrel or cylinder are a very close lapped fit to minimize leakage. The fuel inlet port is uncovered at the bottom end of the plunger stroke and the partial vacuum in the barrel causes fuel flow into the barrel. On the upward plunger stroke the pump delivers fuel when the plunger covers the fuel inlet ports and the fuel flows past the discharge valve to the nozzle until the spill port is uncovered. Then fuel flows out of the pump cylinder or barrel and through the line until the delivery valve closes and maintains a desired line residual pressure until the next injection; the amount of fuel injected is varied by changing the effective plunger stroke by turning the plunger in its barrel so as to change the time of by-pass, i.e. the time of uncovering the spill port by a helical edge of the plunger thereby varying the duration of the effective plunger stroke and the amount of fuel injected. The by-pass occurs when the upper helical edge of the wide plunger groove uncovers the spill port. Fuel delivery then ceases and the seating of the special delivery valve retracts fuel from the discharge tubing to sharply terminate injection. To achieve such a fuel flow rate control the plunger is made rotatable about its longitudinal center line axis and the volumetric amount of liquid fuel actually discharged at every useful or effective plunger stroke is selectively variable by adjusting the instant relative angular position of said plunger by means for instance of a conventional control rod or rack meshing with a mating gear coaxially carried by the plunger for operating same. For that purpose such a plunger is formed in an intermediate portion of its sidewall surface on the one hand with an at least approximate and partially annular groove forming an intermediate plunger part of reduced cross-section or diameter, defined and extending between two circumferential shoulders or steps and dividing the plunger into two sections or segments, namely: an upper or volumetric slow rate adjusting section and a lower section (or discharge section proper). On the other hand said sidewall surface is provided in its upper section with at least one recess for releasing fuel pressure whereby the excess fuel at the end of the effective injection is caused to flow back round the plunger while following a by-pass return path consisting of a channel or like hollow formation opening into and leading from the transverse top end face of the plunger to extend down to and open into said annular groove. The recess therefore consists of a slot-like groove having one straight edge extending in parallel relation to the longitudinal centre line axis or generating lines of the plunger along and throughout said upper section thereof whereas its opposite edge comprises a relatively short straight upper portion extending in parallel relation to said longitudinal centre line axis of the plunger and a remaining or lower portion shaped as a substantially helical ramp which widens said slot-like groove from top to bottom while extending down to the bottom edge of the upper section of the plunger, i.e. to said annular groove where it is leading thereinto. The evolutive height of the sidewall surface of the plunger, defined between its circular top end rim and the edge of said helical ramp, determines the actual stroke or effective duration of the fuel delivery hence injection under pressure through co-operation with a radial spill port for the fuel back or return flow through the cylindrical wall of the pump barrel. The plunger is often formed with two such slot-like grooves and helical ramps arranged in substantially symmetrical relationship with respect to the longitudinal center line axis of the plunger.

With such a conventional injection pump plunger the diameter of said reduced intermediate section consisting of said partially annular neck-like or throat-shaped groove is generally ranging from about 70% to about 80% of the normal outside diameter of the plunger so that the depth of said slot-like groove or hollow formation is of about 15% to about 10% of the normal outside diameter of the plunger. By way of merely illustrative example a known pump plunger has a normal outside diameter of 43 mm and a depth of slot-like groove of 5 mm. The adjustment of the volume of fuel delivered by the pump is performed by acting through said control means upon the relative angular position of the plunger the recess of which together with its helical adjusting ramp or edge would convey the fuel (through by-passing of flowing round the plunger) towards said radial spill port extending through the cylindrical wall of the pump barrel and which forms the outlet port for the return flow of excess fuel. The rotary displacement of the plunger and accordingly of the helical ramp or edge will cause a time lag or lead of the uncovering of said port the opening of which may thus be either delayed or advanced, said port being at first covered or blocked by the outer solid land or sidewall portion of the plunger (first part of its upward stroke) and being then uncovered or opened by the latter upon the last part of its upward stroke after a more or less extended time (duration of port blocking set by the instant angular position of the plunger). Thus the fuel delivery flow rate is increased or decreased since the delivery is always initiated at the same time as soon as the top rim or upper end edge of the plunger has moved past and beyond said radial port. At the time where the plunger is just beginning to uncover said port at the end of the injection period (under a delivery pressure for instance of about 1,000 bar) the working space or chamber above the plunger is suddenly put in communication through said radial port with an annular fuel suction sump extending about the pump barrel and formed in the pump housing (which sump is at a fuel feed or supply pressure of a few bars only) so that there occurs a sudden pressure relief which gives rise to substantial fluctuations or very large pressure waves or surges hence heavy hydraulic oscillations in the fuel pipe-line connecting the injection pump to the injector or injection nozzle fed by the pump. This would result in a cavitation risk and a hazard of operating instability of the injector valve needle through undue needle lifting likely to cause burnt combustion gases to enter the injector and damage same.

Attempts have already been made to alleviate or overcome such an inconvenience by increasing the pressure head loss induced by the liquid flowing through the by-pass return passage-way so as to thereby obtain a more gradual pressure release at the end of the injection step. Such an increase in pressure head loss has been achieved by decreasing the free cross-sectional surface area of said by-pass or return passage-way. Thus a known method consists in narrowing said slot-like groove of the plunger by reducing its circumferential or transverse width. Another known method consists in providing a helical ramp or edge with at least two restricting steps or throttling stages by providing an intermediate step located for instance at a depth of 0.2 mm from the outer sidewall surface of the plunger or by providing a small radial leakage port below the normal radial fuel outlet or inlet port in the wall of the pump barrel. Each one of those prior art approaches requires a very accurate manufacture with very close tolerances and is accordingly relatively expensive to be carried out. Moreover said approaches do not reduce at all or very much the parasitic torque exerted upon the plunger in view of the pressure force applied against the edges or sidewalls of said slot-like groove of the plunger, which torque is conducive to increase the wear of the control rack actuating the rotation of the plunger (with a view to operate an adjustment of its angular position).

A main object of the invention is therefore to obviate said drawbacks by providing a method of slowing down the pressure drop of the fluid at the end of each injection period with attendant damping or braking of the hydraulic oscillations within the pump working chamber and accordingly within the high pressure delivery pipe-line of a fuel injection force-pump or jerk-pump with a reciprocating, constant-linear stroke plunger providing a duration of effective delivery or a time of releasing pressure by allowing excess fuel to escape from said chamber which is adjustable in a selectively variable manner. For this purpose the method according to the invention is characterized in that it consists in decreasing the speed of pressure drop, hence reducing the repeated sudden variations in pressure and the attendant periodical fluctuations of flow movement resulting from said pressure release, by increasing through design the overall added effects of the various pressure head losses of the fuel return flow when by-passing the plunger, said increase being achieved through a decrease in the free passage-way cross-sections successively flowed through by said fuel backflow along its return path which communicates with part of said working chamber that lies above the end top face of said plunger with the outside. This may be obtained by reducing the depth of each aforesaid slot-like groove in the plunger, i.e. the thickness of the edges of that groove.

The invention is characterized in that the diameter of said partially annular circumferential groove is lying between about 88% and about 95% of the normal outside diameter of the plunger so that the depth of said slot-like groove or like hollow formation in the plunger sidewall is lying between about 6% and about 2.5% of the normal outside diameter of said plunger. This arrangement offers the advantage of providing a plurality of hydrodynamic resistances to flow. These resistances, which are added in series are: the vertical portion of each slot-like groove of the plunger, the inlet cross-sectional area of each port in the pump barrel located below each helical ramp or edge of the plunger and the cross-sectional area of the port in the barrel which is uncovered by each helical ramp or edge.

This permits achievements of a more economical production by desirably reducing the required accuracy in machining each one of said flow resistance generating portions the manufacturing tolerances of which are thus broadened to a large extent (for instance by being five times larger). Moreover, as the pressure forces which are producing said parasitic torque are directly proportional to the sectional surface area of the edges of the groove, the construction according to the invention will result in a decrease of that torque in view of the decrease in depth of the groove or hollow formation. By way of merely illustrative example in a plunger having a normal outside diameter of 43 mm for instance the depth of the groove may advantageously be of 1.5 mm with a manufacturing tolerance of $\pm$ 0.1 mm (instead of $\pm$ 0.02 mm in the prior art), with a depth of 0.5 mm of the intermediate step in said known plunger.

Said plunger groove may either be uniform and identically the same throughout or according to another characterizing feature of the invention its vertical portion and its portion located below the helical ramp may have differing depths, respectively, but always lying within the limits referred to herein above.

In fact such a depth of said hollow formation in the plunger sidewall may vary slightly depending upon the regions of said hollow formation for purposes of facilitating the machining operations. In particular since the hollow formation should compulsorily comprise a vertical groove portion opening into the edge of the transverse top end face of the plunger it is advantageous to provide that vertical portion by forming a vertical flattening which extends length-wise from said transverse top end face down to the upper ring-like face of the lower or delivery plunger section. It is obvious that at that flattened portion the depth of the hollow formation is slightly increased with respect to its value anywhere else. Such an increase, however, is small enough and the tolerances on or variations in said depth are so large (as substantiated by said relative limits) that the effects aimed at by the invention may be considered as having being obtained when the major part of the hollow formation has a depth lying between the stated limits.

It has been found, however, in some operating cases of use at an extensive rate that the sidewall surface of the hollow formation was subjected to an early wear through cavitation. It is known that cavitation is the phenomenon in which a cavity is formed between the down-stream surface of a body and a flowing liquid normally in contact with the body, the cavity being separated from the remainder of the liquid by a surface of discontinuity and filled with a non-homogeneous liquid/vapour mixture, in places where the pressure falls below the saturated vapour pressure of the liquid at the actual temperature. Since the static pressure in a closed stream of fluid drops as the velocity of the flow is increased locally, the fluid velocities in a closed stream reach a definite upper limit as soon as the absolute pressure becomes equal to the vapour pressure of the fluid. When this limit is reached the fluid vaporizes, forming vapour pockets in the stream which disturb the flow and by their subsequent collapse produce vibrations, noise and destruction of the surrounding walls. This form of vaporization in a rapid stream of fluid is called cavitation. In the present instance cavitation results from the occurrence of substantially large local vacuums at times when the working chamber of the pump is suddenly put again in communication with the fluid feed-lines, i.e. at the end of each delivery cycle. A thorough investigation has shown that cavitation is produced when the fluid returns suddenly to the feed-ducts of the pump at the end of each delivery period and the direction of the fluid tends to be substantially vertical and in substantial alignment with the initial vertical guide path provided by said vertical groove portion. Therefore when following that direction with a high velocity the liquid motion tends to give rise to a substantial underpressure or vacuum in those portions of said hollow formation which are directly adjacent to that preferential path of flow (which is somewhat materialized by said machined flattened portion); and this will result in a cavitation within those parts of the hollow formation which are located below the helical ramp and even on the edge face forming the ramp proper.

Another object of the present invention is to overcome such a difficulty by providing an alternative embodiment or modification likely to avoid or prevent cavitation.

According to the invention the desired result is attained by deepening the vertical groove portion of the hollow formation up to a point lying on a level with the adjacent upper end of the helical ramp so as to provide at that place a set-back or stepped portion or depression of special shape adapted to act upon the periodical backflows at the end of each delivery period in order to cause the fluid jet to diverge and spread out over the whole space or extent of the hollow formation below said stepped depression or set-back portion.

More specifically the alternative embodiment of the fuel injection pump plunger provided with said hollow formation of reduced depth is characterized in that the vertical portion of said groove is deeper than its portion located substantially below a point on a level with the upper end of said helical ramp so as to define between both portions of differing depths a setback portion or stepped depression for scattering or distributing the return flow of the fluid, said flow-scattering set-back being thus at least approximatively located in the vicinity of said upper end of said helical ramp.

That particular structural configuration of the hollow formation in the plunger sidewall produces several effects which contribute to the achievement of the desired result:

On the one hand the deepened vertical groove portion induces a very little decrease only in the total pressure head losses the occurrence of which is desired according to the first object of the invention. The slowing down of the pressure drop at the end of every delivery cycle is therefore still effective. The velocity and pressure of the fluid flowing back towards the feed circuit of the pump are however substantially reduced.

On the other hand at the outlet of the vertical portion of the groove in said hollow formation the fluid flow is deflected or distributed in all directions owing to the provision of said set-back portion or stepped depression, thereby resulting in the vanishing of the vacuum regions because the fluid now actually fills the whole available space or volume of the hollow formation.

Figure 3:
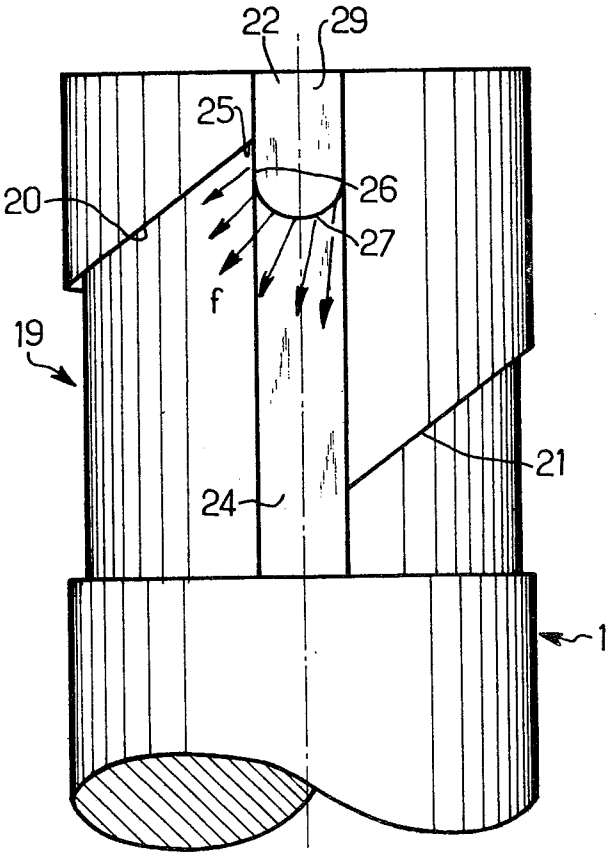
Figure 2:
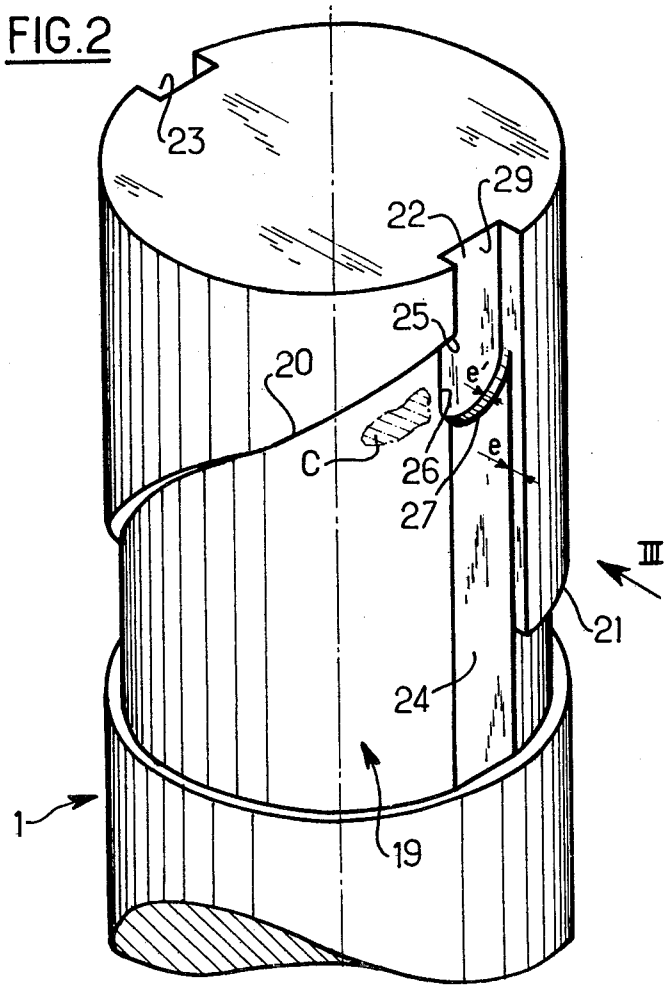

The invention will be better understood and further objects, characterizing features, details and advantages thereof will appear more clearly as the following explanatory description proceeds with reference to the accompanying diagrammatic drawings given by way of non-limiting examples only illustrating two presently preferred specific forms of embodiment of the invention and in which:

FIG. 1 is a fragmentary perspective detail view of the upper part of a fuel injection pump plunger according to a first embodiment of the invention;

FIG. 2 is a view similar to the foregoing one but showing the plunger modified according to an alternative embodiment to be provided with two symmetrically opposite helical ramps; and FIG. 3 is a diagrammatic front view seen when looking in the direction of the arrow III in FIG. 2 and illustrating the scattering or distribution of the jet of fluid return flow at the end of actual delivery period of the plunger upward sroke.

According to the exemplary embodiment shown in FIG. 1 of the drawings the cylindrical piston or plunger 1 of the pump with a substantially vertical longitudinal center line axis 2 and an outside diameter D comprises an intermediate portion 3 of reduced cross-section or with a smaller diameter *d* forming a groove or like hollow formation of a certain height and with a depth *e*, which is defined between two successive vertically spaced circumferential partially parallel shoulders 4, 5 and divides the plunger 1 into two segments or sections, namely an upper or slow rate adjusting section 6 and a lower or delivery section 7.

The aforesaid groove 8 having the same aforesaid depth *e* and the radially inner wall of which consists of the sidewall surface of said reduced portion 3 of the plunger, comprises a straight edge 9 extending in parallel relation to the longitudinal centre line axis 2 or to the generating lines of the cylindrical surface of the plunger over the whole upper section 6 of the latter thereby forming a substantially flat sidewall of the groove extending substantially at right angles to the lateral surface of the portion 3 of reduced cross-section. The opposite edge 10 of the groove comprises a relatively short upper portion 10' extending in parallel relation to the longitudinal centre line axis 2 of the plunger and defining a flat sidewall portion of groove extending at right angles to the lateral surface of reduced diameter 3 and a lower or remaining portion curved in the shape of a helical ramp which widens the groove by extending downwards to the hollow or neck-like portion 3 i.e. to the bottom edge 5 of the upper plunger section 6. The groove opens with its upper end into the transverse top end face 11 of the plunger.

According to the invention the designed dimensions of the plunger should satisfy the following inequalities:

$$0.88.D \leqq d \leqq 0.95.D$$

$$0.025.D \leqq e \leqq 0.06.D$$

As already stated previously one may have for instance:

$$D = 43 \text{ mm}, d = 40 \text{ mm and } e = 1.5 \text{ mm with } 38 \text{ mm} \leqq d \leqq 41 \text{ mm}.$$

According to the modification shown in FIGS. 2 and 3 of the drawings the plunger 1 exhibits the same essential parts as in FIG. 1. The plunger may, however, be provided for instance with two helical ramps 20, 21 and grooves 22, 23 respectively, arranged in substantially symmetrical relationship with respect to the center line axis of the plunger. However, only the ramp 20 is shown in FIG. 2 which accordingly also shows two vertical groove portions 22 and 23. With the view to facilitating machining operations, the lateral hollow formation 19 corresponding to the ramp 20 (i.e. the section of lesser diameter located adjacent to and below said ramp 20) is formed with a vertical flattened portion 24 in substantially aligned registering relationship with the groove portion 22. The depth of that hollow formation may however be considered to a first approximation as being constant and equal to the value $e$ defined herein above except for the vertical groove portion 22. According to the invention the depth of that vertical groove portion 22 is increased by an amount $e'$ thereby defining substantially at the level and in the vicinity of the upper end 25 of the helical ramp 20, a kind of set-back portion or stepped depression 26 the ridge of which is intended to give rise to a scattering or distribution of the fluid return flow. The special arcuate concave profile in the shape of an arc of circumference and preferably a semi-circular arc as shown of that set-back or step having a thickness $e'$ enables indeed to scatter or disperse the jet of fluid return flow in all directions as shown by the arrows $f$ in FIG. 3. The special profile refers to the shape of the step or edge 27 of the set-back portion or depression along the sidewall surface of the plunger such as shown in FIGS. 2 and 3.

That special profile may either be curved as shown or it may also have a polygonal contour provided that it is formed with some concavity. The surface of said step proper of the depression in the direction of its thickness is in the embodiment shown perpendicular throughout to both flattened surfaces 24 and 29 which it separates from each other but that surface could also have some other particular profile if it proves to be advantageous to even more limit the risks of cavitation.

The best results were found to have been obtained with $e = e'$.

In other words the vertical groove portion 22 has a depth which is substantially twice as large as that of the remainder of the lateral hollow formation of the plunger located substantially underneath the helical ramp 20 and the set-back or step 26.

In operation of the pump if the plunger 1 is not provided with the set-back or step 26, the jet of fluid backflow at the end of every delivery cycle of the pump would have the tendency to follow an essentially vertical direction that is along a direction parallel to the flattening in the vertical (non-deepened) groove portion. Under such circumstances a large local underpressure or vacuum is likely to occur below the upper part 25 of the helical ramp in particular in the hatched area C shown in FIG. 2. This vacuum when repeated during each operating cycle may give rise to a relatively quick wear through cavitation. Owing to the improvement provided by the present modification the liquid jet is dispersed or scattered when issuing from the deepened vertical groove portion 22 at the level of the set-back portion or stepped depression 26 (FIG. 3) so that no vacuum may occur in or about the region C.

It should be understood that the invention is not at all limited to the forms of embodiment described and shown herein which have been given by way of illustrative examples only. In particular it comprises all the means constituting technical equivalents of the means described as well as their combinations if same are carried out according to its gist and used within the scope of the appended claims.

What is claimed is:

1. A plunger of a constant-stroke, variable delivery rate fuel injection pump for an internal combustion engine, said plunger being of general cylindrical shape with a top end face and being rotatable about its longitudinal center line axis relative to a fixed reference position for cooperating with a pump port to selectively vary the volume of fuel delivered by said pump for each stroke of said plunger in accordance with the relative angular position of said plunger with respect to said fixed reference position, and wherein the plunger includes a peripheral surface having a first outer diameter, and an intermediate portion of reduced cross section that divides the peripheral surface of said plunger into an upper segment terminating at said top end face and a lower segment having the same outer diameter as the upper segment, said plunger including at least one pressure releasing recess having a first predetermined radial depth from the first outer diameter and first and second spaced and parallel sidewalls extending longitudinally from the top end face toward the intermediate portion in a direction parallel to the center line axis of said plunger to define a groove, said first sidewall being longer than said second sidewall, and wherein the upper segment has a helically shaped lower edge portion extending from the lowermost portion of said first sidewall to the lowermost portion of said second sidewall so as to widen said groove beyond the lowermost portion of said second sidewall in a direction away from said top end face towards said intermediate portion, and wherein the improvement comprises, limiting the predetermined radial depth of said recess to a range of approximately 6% to 2.5% of the first outer diameter, and wherein a part of said recess defined between said first and second sidewalls is radially deeper than the remaining part of said recess so as to define a flow-scattering stepped depression extending longitudinally from said top end face to a level that is adjacent to and closer to the lowermost edge portion of the second sidewall than the lowermost edge portion of the first sidewall.

2. A plunger according to claim 1, wherein said flow-scattering stepped depression has a concave profile.

3. A plunger according to claim 2, wherein said flow-scattering stepped depression has a substantially arcuate semi-circular profile.

4. A plunger according to claim 1, wherein said stepped depression has a radial depth which is twice as large as that of said recess.

* * * * *